US010408051B2

(12) United States Patent
Lee et al.

(10) Patent No.: US 10,408,051 B2
(45) Date of Patent: Sep. 10, 2019

(54) DEVICE FOR MEASURING SUSPENSION IN DRILLING FLUID AND THICKNESS OF SLIME AT THE BOTTOM OF PILE BOREHOLE

(71) Applicant: KOREA UNIVERSITY RESEARCH AND BUSINESS FOUNDATION, Seoul (KR)

(72) Inventors: Jong Sub Lee, Seoul (KR); Seung Yong Shin, Seoul (KR); Gyu Seong Woo, Chungcheongbuk-do (KR)

(73) Assignee: KOREA UNIVERSITY RESEARCH AND BUSINESS FOUNDATION, Seoul (KR)

( * ) Notice: Subject to any disclaimer, the term of this patent is extended or adjusted under 35 U.S.C. 154(b) by 202 days.

(21) Appl. No.: 15/648,025

(22) Filed: Jul. 12, 2017

(65) Prior Publication Data

US 2018/0016894 A1 Jan. 18, 2018

(30) Foreign Application Priority Data

Jul. 13, 2016 (KR) ..... 10-2016-0088833

(51) Int. Cl.

| | |
|---|---|
| ***E21B 47/18*** | (2012.01) |
| ***E21B 47/024*** | (2006.01) |
| ***E21B 47/026*** | (2006.01) |
| ***E21B 47/04*** | (2012.01) |
| *E02D 27/52* | (2006.01) |

(52) U.S. Cl.

CPC ..... *E21B 47/18* (2013.01); *E21B 47/024* (2013.01); *E21B 47/026* (2013.01); *E21B 47/04* (2013.01); *E02D 27/52* (2013.01)

(58) Field of Classification Search

CPC ..... E21B 47/04; E21B 47/024; E21B 47/18
USPC ..... 73/81, 84, 85
See application file for complete search history.

(56) References Cited

U.S. PATENT DOCUMENTS 3,610,035 A * 10/1971 Handy ..... E02D 1/022 73/784
3,611,794 A * 10/1971 De Geeter ..... E21B 49/006 175/50
3,960,008 A * 6/1976 Goble ..... E02D 33/00 73/84
4,302,967 A * 12/1981 Dufey ..... E02D 1/022 73/84

(Continued)

FOREIGN PATENT DOCUMENTS

| | | | |
|---|---|---|---|
| JP | 60-091202 | | 5/1985 |
| JP | 5528642 | B2 | 6/2014 |
| WO | WO 2013080296 | * | 6/2013 |

*Primary Examiner* — John Fitzgerald
(74) *Attorney, Agent, or Firm* — Rabin & Berdo, P.C.

(57) ABSTRACT

The present invention relates to a device for measuring a suspension in a drilling fluid and a thickness of slime at the bottom of a pile borehole, the device including: a data cable 300 insertable into the pile borehole; a slime-meter probe 200 connected to one end of the data cable 300 in such a manner as to be descended to the interior of the pile borehole by the own weight thereof to measure the thickness of the slime at the bottom of the pile borehole; and a slime-meter outer part 100 mounted on the outside of the slime-meter probe 200 in such a manner as to be movable relatively to the slime-meter probe 200 when reaches the bottom of the pile borehole.

9 Claims, 6 Drawing Sheets

(56) References Cited

U.S. PATENT DOCUMENTS

| | | | | |
|---|---|---|---|---|
| 4,400,970 | A * | 8/1983 | Ali | E02D 1/022 73/84 |
| 5,099,696 | A * | 3/1992 | Yabuuchi | E02D 1/02 405/232 |
| 6,925,858 | B2 * | 8/2005 | Miles | G01N 3/303 73/12.06 |
| 8,151,658 | B1 * | 4/2012 | Ding | E21B 47/00 73/865.8 |
| 2004/0160514 | A1 * | 8/2004 | Tawfig | E21B 47/0002 348/85 |
| 2012/0073363 | A1 * | 3/2012 | Ding | E21B 47/00 73/152.54 |
| 2015/0211353 | A1 * | 7/2015 | Ding | E21B 47/00 73/152.54 |
| 2015/0233230 | A1 * | 8/2015 | Likins, Jr. | E02D 1/02 166/254.1 |

* cited by examiner

DEVICE FOR MEASURING SUSPENSION IN DRILLING FLUID AND THICKNESS OF SLIME AT THE BOTTOM OF PILE BOREHOLE

BACKGROUND OF THE INVENTION

Field of the Invention

The present invention relates to a device for measuring a suspension in a drilling fluid and a thickness of slime at the bottom of a pile borehole so that a concentration of the suspension in the drilling fluid of the pile borehole is estimated and the bottom of the pile borehole is searched to expect and accurately measure the thickness of suspension (slime) settled at the bottom of the pile borehole.

Background of the Related Art

When the load of a structure is not supportable against a shallow foundation form on soft ground, pile foundation is generally used as a deep foundation form so that the load of the structure is delivered to a relatively deep support layer capable of supporting the load of the structure.

Piles currently used in the pile foundation are classified into a driven pile, a bored pile, and an embedded pile according to construction methods.

The bored pile method is carried out by boring the ground, inserting a steel mesh into the pile borehole, and filling concrete into the pile borehole, and the embedded pile method is carried out by inserting a precast concrete pile into a pile borehole. In case of the bored pile method and the embedded pile method, accordingly, the state of the bottom of the pile borehole has a big influence on the support force of the pile. However, unfortunately, it is hard to directly check the state of the bottom of the pile borehole.

In case of the bored pile method and the embedded pile method, a given period of time is required until the pile construction is finished after the ground has been bored, and accordingly, drilling is needed to prevent the collapse of the pile borehole. To do this, generally, a solution to which bentonite or polymer is mixed is used as a drilling fluid, so that the solution is filled into the pile borehole to apply a pressure to the outside of the pile borehole from the inside thereof.

A suspension in the pile drilling fluid is settled at the bottom of the pile borehole, thereby giving a bad influence on the support force of the pile. The suspension settled at the bottom of the pile borehole is called 'slime', and if a layer of slime is formed, it makes a quality of pile construction bad. Accordingly, the slime accumulated at the bottom of the pile borehole is removed from the pile borehole by means of a substitution pump, an airlift pump, or the like.

So as to check whether the slime settled at the bottom of the pile borehole is well removed and to measure the thickness of the slime, on current construction sites, a ruler to which a weight is tied moves down at the bottom of the pile borehole so that undesirably, the thickness of the slime is measured only by means of a worker' sense of touch. So as to solve the above-mentioned problems, therefore, there is a need for development of a device capable of indirectly checking the state of the bottom of the pile borehole.

SUMMARY OF THE INVENTION

Accordingly, the present invention has been made in view of the above-mentioned problems occurring in the prior art, and it is an object of the present invention to provide a device for measuring a suspension in a drilling fluid and a thickness of slime at the bottom of a pile borehole to check the depth of the bottom of the pile borehole and the state of the slime accumulated at the bottom of the pile borehole, so that unlike the conventional method used on current construction sites in which a ruler with a weight moves down at the bottom of the pile borehole so that the depth of the bottom of the pile borehole and the thickness of the slime are measured only by means of the worker' sense of touch, that is, his or her subjective reference, without ensuring objectivity, the device according to the present invention can estimate a concentration of the suspension in the pile drilling fluid of the pile borehole, and at the same time estimate the depth of the bottom of the pile borehole and the thickness of the slime.

According to one aspect of the invention, the invention provides a device for measuring a suspension in a drilling fluid and a thickness of slime at the bottom of a pile borehole, the device comprising: a data cable insertable into the pile borehole; a slime-meter probe connected to one end of the data cable in such a manner as to be descended to the interior of the pile borehole by the own weight thereof to measure the thickness of the slime at the bottom of the pile borehole; and a slime-meter outer part mounted on the outside of the slime-meter probe in such a manner as to be movable relatively to the slime-meter probe when reaches the bottom of the pile borehole.

In the device, the slime-meter probe may have a probe tip disposed at the front end thereof to sense the changes in specific resistances from the contact with the slime at the bottom of the pile borehole.

According to the invention, the device may further comprise a cable tension sensing part connected to the other end of the data cable to measure the tension of the data cable.

In the device, the slime-meter outer part may comprise: a slime-meter outer body located to pass the data cable through the center thereof and to locate the slime-meter probe at the underside thereof; and slime-meter outer legs disposed extended from the underside of the outer periphery of the slime-meter outer body toward the bottom of the pile borehole.

In the device, each slime-meter outer leg may have one or more outer weights coupled thereto.

In the device, each slime-meter outer leg and the outer weight may be screw-coupled to each other in such a manner as to move relatively to each other.

In the device, the slime-meter outer body may have a slime-meter outer body guide extended to the opposite side to the bottom of the pile borehole.

In the device, the slime-meter probe may have a stopper formed on the outer periphery thereof in such a manner as to come into contact with the underside of the slime-meter outer body to prevent the slime-meter probe from being deviated toward the opposite side to the bottom of the pile borehole.

According to the invention, the device may further comprise a controller adapted to receive the sensed signals from the probe tip and the cable tension sensing part, to perform signal processing, and to output the processed signals.

To accomplish the above-mentioned object, according to the present invention, there is provided a device for measuring a suspension in a drilling fluid and a thickness of slime at the bottom of a pile borehole, the device including: a data cable insertable into the pile borehole; a slime-meter probe connected to one end of the data cable in such a manner as to be descended to the interior of the pile borehole by the own weight thereof to measure the thickness of the slime at the bottom of the pile borehole; and a slime-meter outer part mounted on the outside of the slime-meter probe in such a manner as to be movable relatively to the slime-meter probe when reaches the bottom of the pile borehole.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
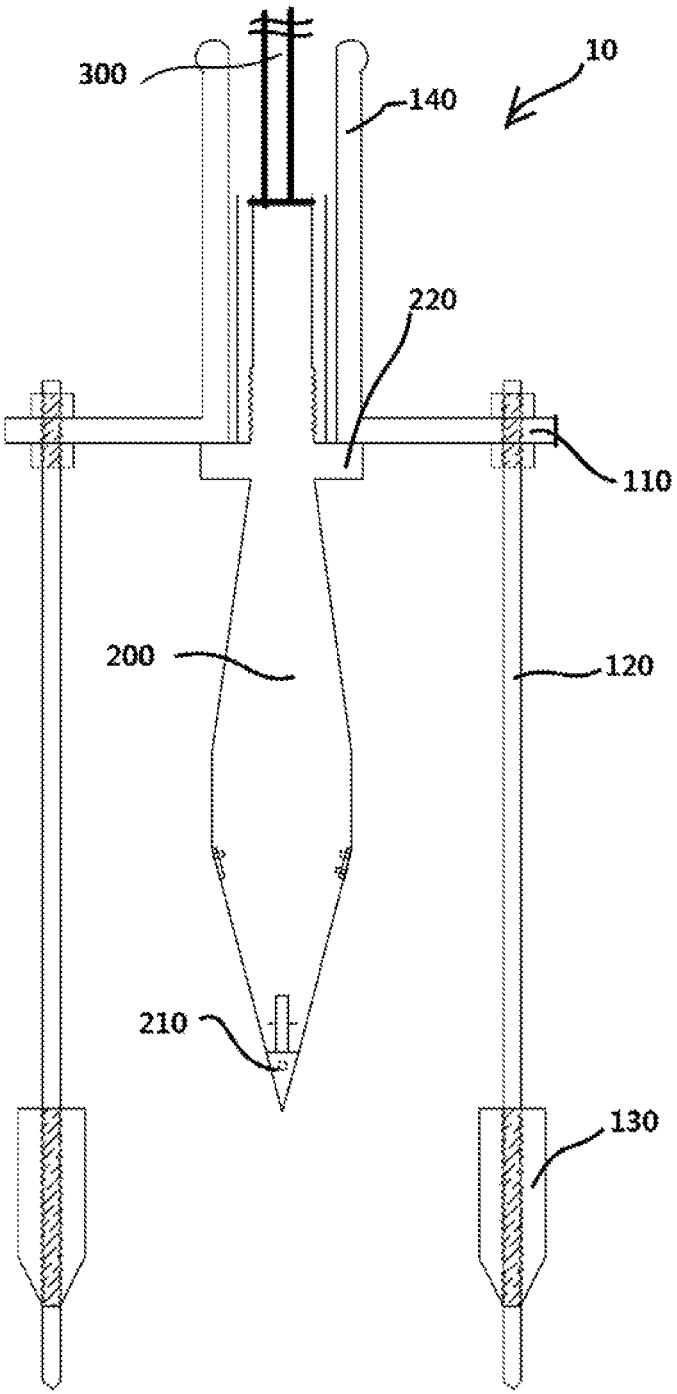
FIGS. 1 and 2 are schematic side and top views showing a device for measuring a suspension in a drilling fluid and a thickness of slime at the bottom of a pile borehole according to the present invention.
Figure 2:
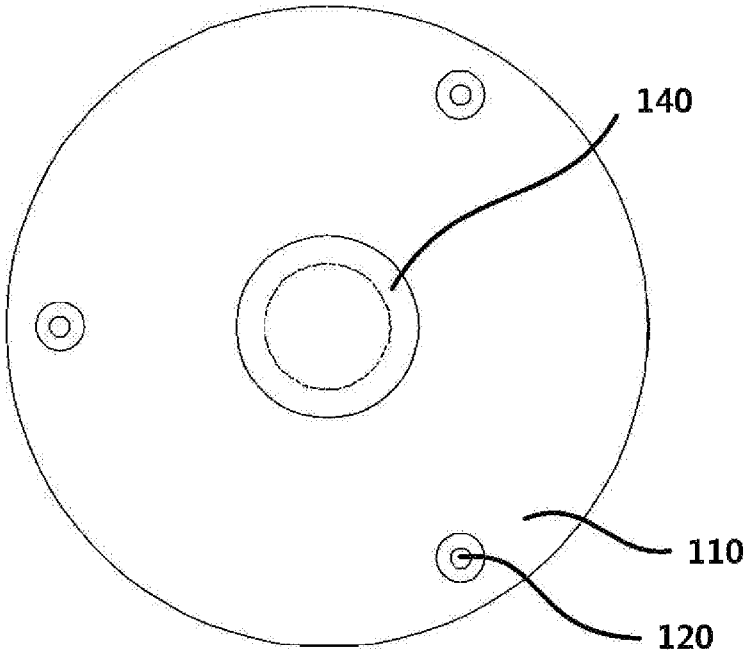

Now, an explanation on a device for measuring a suspension in a drilling fluid and a thickness of slime at the bottom of a pile borehole according to the present invention will be given with reference to the attached drawings.

According to the present invention, a device 10 for measuring a suspension in a drilling fluid and a thickness of slime at the bottom of a pile borehole includes a data cable 300, a slime-meter probe 200, and a slime-meter outer part 100.

The data cable 300 is a cable insertable into the pile borehole, and accordingly, if the ground is first bored to form the pile borehole, the data cable 300 is inserted into the pile borehole.

The data cable 300 is made of various materials like steel, synthetic fiber, carbon fiber and so on according to given design specifications. The data cable 300 has a wire embedded therein or connected to the outside thereof so as to transfer an electrical signal.

The slime-meter probe 200 is connected to one end of the data cable 300 in such a manner as to be descended to the interior of the pile borehole by its own weight to measure the thicknesses of the substances and slime at the bottom of the pile borehole. The slime mater probe 200 has a shape of a given arrowhead-like weight. The slime-meter probe 200 is connected to one end of the data cable 300 and has a function of a given weight in such a manner as to allow the data cable 300 to be located vertically to the surface of ground within the pile borehole by means of its own weight.

The slime-meter probe 200 has a probe tip 210 disposed at the front end thereof, and if the slime-meter probe 200 reaches the bottom of the pile borehole, the probe tip 210 senses the changes in electrical characteristics through the contact with the slime existing at the bottom of the pile borehole. The sensed electrical signal is transferred to a controller 50 located above the ground, so that the electrical characteristics like given specific resistance characteristics are detected. Further, the probe tip 210 senses whether it approaches the bottom of the pile borehole and the changes in the sizes of the electrical signals, thereby providing the sensed signals as data for determining the state of the slime at the bottom of the pile borehole.

The slime-meter outer part 100 is mounted on the outside of the slime-meter probe 200 in such a manner as to be movable relatively to the slime-meter probe 200 when reaches the bottom of the pile borehole. At the time when the slime-meter outer part 100 reaches the bottom of the pile borehole, it ensures that the slime-meter probe 200 is stably positioned to accurately measure the thickness of the slime, so that the slime-meter outer part 100 serves as a given seating guide. According to the present invention, the slime-meter outer part 100 has a shape of a tripod, but is not necessarily limited thereto.

According to the present invention, the slime-meter outer part 100 includes a slime-meter outer body 110 and slime-meter outer legs 120.

The slime-meter outer body 110 is located to pass the data cable 300 through the center thereof and to locate the slime-meter probe 200 at the underside thereof. The slime-meter outer body 110 has a through hole 111 formed at the center thereof in such a manner as to pass the data cable 300 therethrough.

A slime-meter outer body guide 140 is located on the opposite side to the underside of the through hole 111 of the slime-meter outer body 110, that is, on the top of the through hole 111, in such a manner as to be extended to a starting point of the pile borehole. The slime-meter outer body guide 140 has a structure extended in a longitudinal direction and has a hollow shape connected to the through hole 111.

A configuration for preventing one end of the slime-meter probe 200 from being deviated from the slime-meter outer body 110 is formed on the underside of the slime-meter outer body 110, that is, on the opposite side of the slime-meter outer body guide 140. In this case, the diameter of the through hole 111 of the slime-meter outer body 110 has a smaller value than the maximum diameter of the slime-meter probe 200. In some cases, further, the slime-meter probe 200 has a stopper 220 formed on the outer periphery thereof in such a manner as to come into contact with the underside of the slime-meter outer body 110, thereby preventing the direct contact with the slime-meter probe 200 and also preventing the unexpected deviation of the slime-meter probe 200 from the slime-meter outer body 110 toward the opposite direction to the bottom of the pile borehole.

The diameter of the stopper 220 is larger than the diameter of the through hole 111 of the slime-meter outer body 110 so that at least a portion of the outer peripheral surface of the stopper 220 comes into contact with a portion of the underside of the slime-meter outer body 110, thereby preventing the slime-meter probe 200 from being deviated from the slime-meter outer body 110.

On the other hand, the slime-meter outer legs 120 are disposed extended from the underside of the outer periphery of the slime-meter outer body 110 toward the bottom of the pile borehole, and as mentioned above, the slime-meter outer legs 120 have a structure of a tripod so that three legs 120 are disposed at equal angles. According to the present invention, the number of slime-meter outer legs 120 is freely determined according to the design specifications, and in some cases, the slime-meter outer legs 120 may have a cylindrical structure, which is freely changed.

Further, the slime-meter outer legs 120 have parts for ensuring their stable positioning. That is, each slime-meter outer leg 120 has one or more weights 130 coupled thereto so that it can be stably positioned at the bottom of the pile borehole, and after the stable positioning, it allows only the slime-meter probe 200 to be additionally movable, without being changed in position, to accurately sense the electrical characteristics of the slime accumulated at the bottom of the pile borehole.

According to the present invention, furthermore, the weight 130 is mounted in such a manner as to pass each slime-meter outer leg 120 therethrough, but is not limited thereto. In case of such configuration wherein the weight 130 is mounted in such a manner as to pass each slime-meter outer leg 120 therethrough, each slime-meter outer leg 120 and the weight 130 have screw structures so that they are screw-coupled to each other. Through such structures, the weight 130 is adjustable in position along the length of each slime-meter outer leg 120, and the number of weights 130 and the position distribution of the weights 130 are adjustable, thereby achieving various design changes.

On the other hand, the data cable 300 is connected to a driving part such as a winch, motor or the like located above the pile borehole, and in this case, the other end of the data cable 300 is connected to a cable tension sensing part 400. Through such configuration, while the slime-meter probe 200 is being descended along the pile borehole, the tension of the slime-meter probe 200 is constantly maintained by the own weight of the slime-meter probe 200, but if the slime-meter probe 200 reaches the bottom of the pile borehole, the tension thereof is drastically changed. At this time, the cable tension sensing part 400 senses the changes in the tension of the slime-meter probe 200 and transfers the sensed result to the controller 500, thereby sensing whether the slime-meter probe 200 reaches the bottom of the pile borehole.

The electrical signal and the sensed signal of the cable tension sensing part 400 are transferred to the controller 500 and then processed and outputted therethrough.

Figure 3:
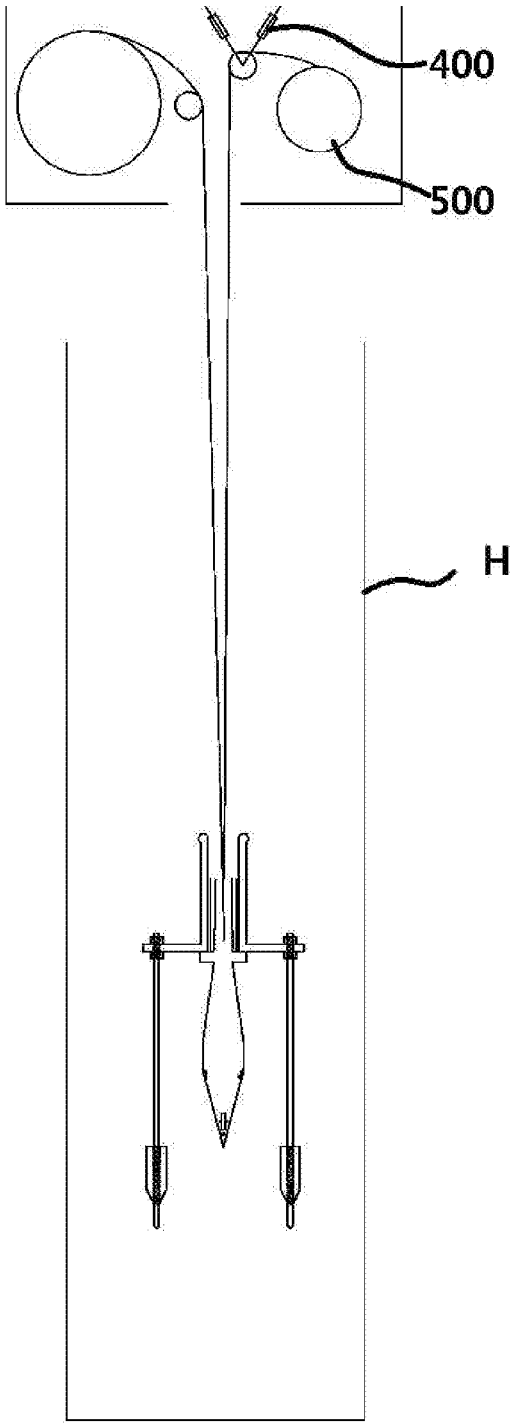
FIGS. 3 to 5 are schematic side views showing the operating states of the device according to the present invention.
Figure 4:
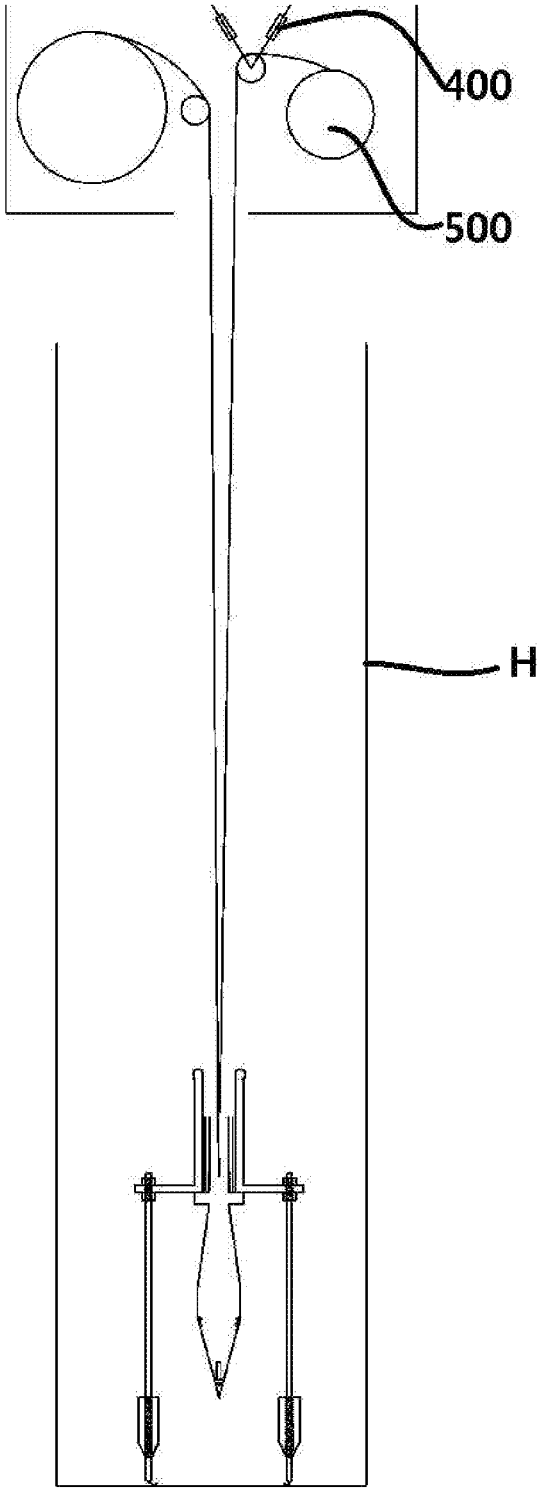

Hereinafter, an explanation on the operating processes of the device 10 according to the present invention will be given with reference to FIGS. 3 to 5.

First, the slime-meter probe 200 and the slime-meter outer part 100 are disposed and descended in the pile borehole H. At this time, the slime-meter probe 200 is connected to the data cable 300, and in the state where the slime-meter probe 200 maintains given tension by means of its own weight, it enters the pile borehole H (See FIG. 3). After that, as described above, the slime-meter probe 200 and the slime-meter outer part 100 are kept descended and finally reach the bottom of the pile borehole H (See FIG. 4). At this time, the slime-meter outer part 100 first reaches the slime accumulated at the bottom of the pile borehole H to ensure a stable measurement position, and through the seating of the slime-meter outer part 100, the tension of the data cable 300 connected to the slime-meter probe 200 is somewhat changed.

Figure 5:
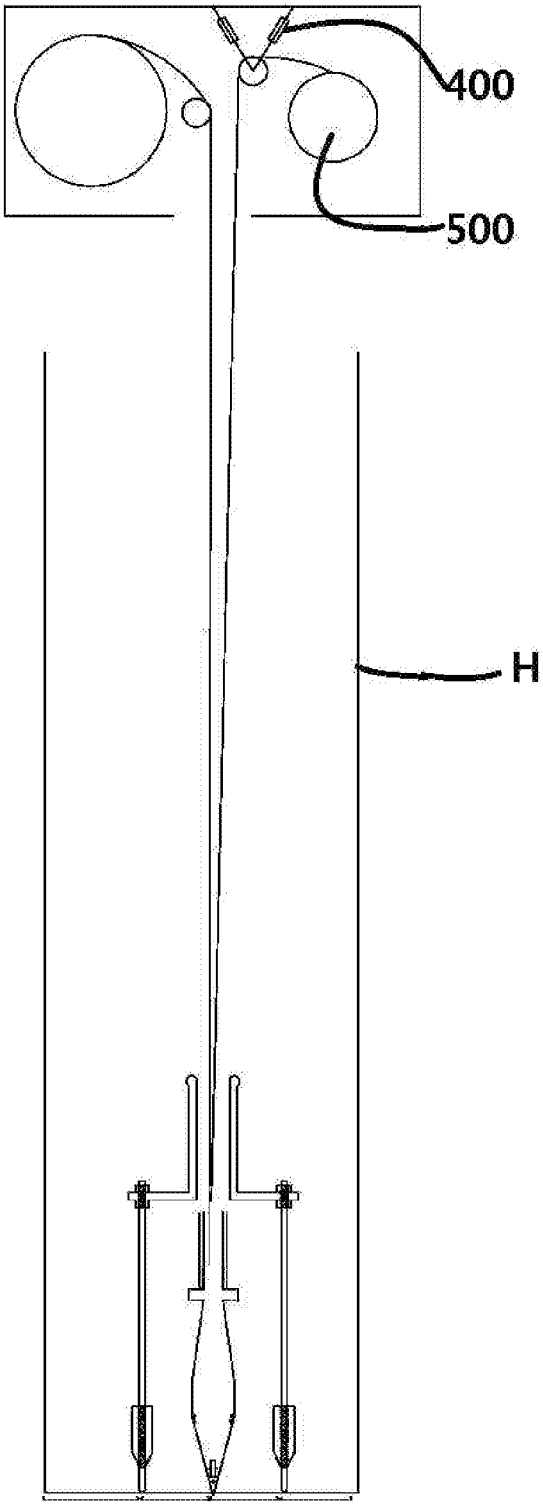

If the slime-meter probe 200 and the slime-meter outer part 100 are kept descended, after that, a relative movement therebetween is generated, so that the slime-meter probe 200 comes into direct contact with the slime accumulated at the bottom of the pile borehole H to sense the electrical signal and change of the slime, and at the same time, a drastic change in the tension applied to the data cable 300 occurs (See FIG. 5). Through the slime approach of the slime-meter probe 200 and the change of the electrical characteristics, specific resistance characteristics are sensed so that the controller 500 processes and outputs the sensed signals.

Figure 6A:
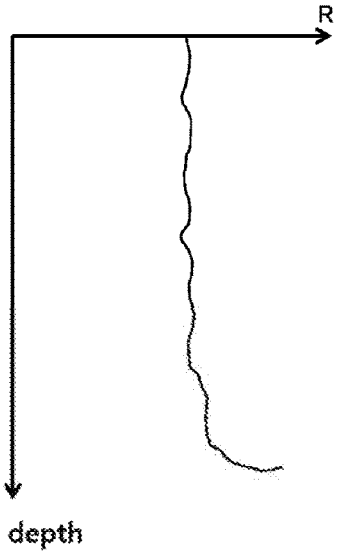
FIGS. 6A, 6B, and 6C are graphs showing the measured values of the device according to the present invention.
Figure 6B:
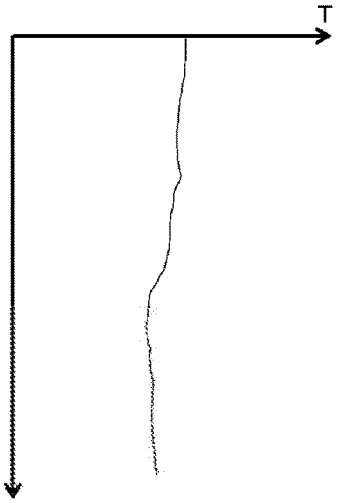
Figure 6C:
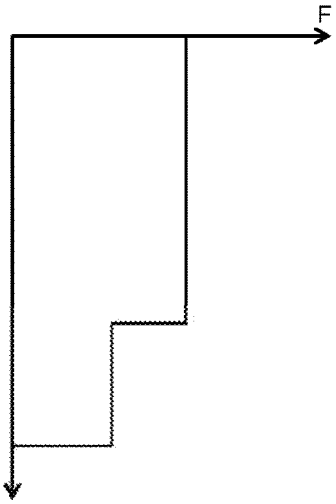

FIGS. 6*a* to 6*c* show the changes of signals in the above-mentioned processes. FIG. 6*a* is a graph showing the changes in specific resistances as electrical characteristics of the slime accumulated at the bottom of the pile borehole, FIG. 6*b* is a graph showing the changes in temperatures in the pile borehole, and FIG. 6*c* is a graph showing the changes in tension of the data cable 300 sensed through the cable tension sensing part 400. Accordingly, the thickness of the slime can be measured through the slime approach of the slime-meter outer part 100 and the slime-meter probe 200, and through the electrical characteristics, further, the existence of foreign matters floating in the suspension of the pile borehole and the quantity thereof are all checked.

As described above, the device according to the present invention first measures electrical specific resistances or electrical resistances by depth of borehole and outputs the measured values to the form of a graph, thereby checking whether foreign matters exist in the pile drilling fluid, their quantity, and the existence of slime. Next, the slime-meter outer part having a tension meter according to the present invention is reduced in tension when the slime-meter probe reaches the bottom of the pile borehole, thereby measuring the depth of the bottom of the pile borehole, and after that, the slime-meter probe according to the present invention is descended to accurately measure the thickness of the slime at the bottom of the pile borehole. Through such method, a depth measurement error caused by the extension of the cable to which tension is applied can be minimized. Further, the device according to the present invention can estimate the quantity of soil and sand existing in the pile borehole according to the depth of the pile borehole and check the state of the bottom of the pile borehole, thereby providing a pile construction method adequate to the pile borehole.

In addition, if the device according to the present invention is applied to the cast-in-place pile, the device can check and control the state of the bottom of the pile borehole, thereby helping the support force of the pile exerted.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A device for measuring a suspension in a drilling fluid and a thickness of slime at the bottom of a pile borehole, the device comprising:

a data cable insertable into the pile borehole;

a slime-meter probe connected to one end of the data cable in such a manner as to be descended to the interior of the pile borehole by the own weight thereof to measure the thickness of the slime at the bottom of the pile borehole; and a slime-meter outer part mounted on the outside of the slime-meter probe in such a manner as to be movable relatively to the slime-meter probe when reaches the bottom of the pile borehole.

2. The device according to claim 1, wherein the slime-meter probe has a probe tip disposed at the front end thereof to sense changes in specific electrical resistances from the contact with the slime at the bottom of the pile borehole.

3. The device according to claim 2, further comprising a cable tension sensing part connected to the other end of the data cable to measure the tension of the data cable.

4. The device according to claim 3, further comprising a controller adapted to receive the sensed signals from the probe tip and the cable tension sensing part, to perform signal processing, and to output the processed signals.

5. The device according to claim 3, wherein the slime-meter outer part comprises:

a slime-meter outer body located to pass the data cable through the center thereof and to locate the slime-meter probe at the underside thereof; and slime-meter outer legs disposed extended from the underside of the outer periphery of the slime-meter outer body toward the bottom of the pile borehole.

6. The device according to claim 5, wherein the slime-meter outer body has a slime-meter outer body guide extended to the opposite side to the bottom of the pile borehole.

7. The device according to claim 5, wherein the slime-meter probe has a stopper formed on the outer periphery thereof in such a manner as to come into contact with the underside of the slime-meter outer body to prevent the slime-meter probe from being deviated toward the opposite side to the bottom of the pile borehole.

8. The device according to claim 5, wherein each slime-meter outer leg has one or more outer weights coupled thereto.

9. The device according to claim 8, wherein each slime-meter outer leg and the outer weight are screw-coupled to each other in such a manner as to move relatively to each other.

* * * * *